US006485694B1

(12) United States Patent
Reck et al.

(10) Patent No.: US 6,485,694 B1
(45) Date of Patent: Nov. 26, 2002

(54) HONEYCOMB BODY WITH A CROSS-SECTIONAL REGION WHICH IS BORDERED IN THE INTERIOR, IN PARTICULAR FOR SMALL ENGINES

(75) Inventors: Alfred Reck, Kürten; Wolfgang Maus, Bergisch-Gladbach; Uwe Siepmann, Köln, all of (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/370,232

(22) Filed: Aug. 9, 1999

Related U.S. Application Data

(63) Continuation of application No. PCT/EP98/00570, filed on Feb. 3, 1998.

(30) Foreign Application Priority Data

Feb. 7, 1997 (DE) ..... 197 04 689

(51) Int. Cl.[7] ..... B01D 53/88; B01J 35/04; F01N 3/28

(52) U.S. Cl. ..... 422/180; 422/171; 422/177; 428/593; 502/527.19

(58) Field of Search ..... 422/171, 177, 422/180; 29/890; 502/439, 527.19–527.22; 428/593–594, 116

(56) References Cited

U.S. PATENT DOCUMENTS

| | | | | |
|---|---|---|---|---|
| 4,195,063 A | | 3/1980 | Iwaoka et al. | 422/180 |
| 5,045,403 A | * | 9/1991 | Maus et al. | 428/116 |
| 6,190,784 B1 | * | 2/2001 | Maus et al. | 428/593 |

FOREIGN PATENT DOCUMENTS

| | | |
|---|---|---|
| DE | 24 36 559 A1 | 2/1976 |
| DE | 37 15 040 A1 | 11/1987 |
| DE | 38 29 668 A1 | 6/1989 |
| DE | 296 11 143.0 U1 | 10/1996 |
| EP | 0 049 489 B1 | 4/1982 |
| EP | 0 049 489 A1 | 4/1982 |
| EP | 0 152 560 B1 | 8/1985 |
| EP | 0 473 081 A1 | 3/1992 |
| EP | 0 470 113 B1 | 2/1993 |
| EP | 0 484 364 B1 | 9/1993 |
| GB | 2 231 283 A | 11/1990 |
| JP | 61 096 120 | 5/1986 |
| JP | 6 165 940 | 6/1994 |
| WO | WO 90/13736 | 11/1990 |
| WO | WO 93/20339 | 10/1993 |
| WO | WO 97/01023 | 1/1997 |

* cited by examiner

*Primary Examiner*—Hien Tran
(74) *Attorney, Agent, or Firm*—Laurence A. Greenberg; Werner H. Stemer; Gregory L. Mayback

(57) ABSTRACT

A catalytic converter assembly for an exhaust gas system of an internal combustion engine, in particular for a small engine. The catalytic converter assembly has a housing and a catalytic converter formed of at most two layers formed of sheets disposed in the housing. The catalytic converter has an at least partially curved elongated body and at least one structured sheet with a structuring and a catalytically active material. The at least one structured sheet is wound on inclinedly around the elongated body and at least partially bears against the housing. The structuring of the at least one structured sheet in addition with one of the housing and a sheet of a layer of the at most two layers define closed passages there-between through which exhaust gases can flow and such that, as considered over the cross-section of the housing, a cross-sectional area bordered in by the closed passages constitutes at least half of a total of the cross-sectional area of the housing.

50 Claims, 6 Drawing Sheets

HONEYCOMB BODY WITH A CROSS-SECTIONAL REGION WHICH IS BORDERED IN THE INTERIOR, IN PARTICULAR FOR SMALL ENGINES

CROSS-REFERENCE TON RELATED APPLICATION

This is a continuation of copending International Application PCT/EP98/00570, filed Feb. 3, 1998, which designated the United States.

BACKGROUND OF THE INVENTION

Field of the Invention

The present invention concerns a catalytic converter in a housing for an exhaust gas system of an internal combustion engine, in particular a small engine. The catalytic converter has at least one structured metal sheet which is provided with a catalytically active material and which is wound or twisted, and is formed with passages through which exhaust gas can flow, and which at least partially bears against the housing. The invention also concerns a silencer or muffler for an exhaust gas system of an internal combustion engine and a process for the production of a catalytic converter carrier body which is disposed in an exhaust gas system of an internal combustion engine, in particular a silencer or muffler for a small engine.

It is known for catalytic converters for exhaust gas systems of an internal combustion engine to be in the form of a honeycomb body. The honeycomb bodies are produced from sheet metal layers that are stacked or wound or twisted together. Other honeycomb bodies in turn contain sintered or extruded material. Those catalytic converters are intended to ensure that the convertible gases that still remain in the exhaust gas are further converted. A large number of ever increasingly strict exhaust gas requirements, in particular in relation to motor vehicles, results in that the catalytic converters must be of a configuration that they ensure almost complete conversion, even when the catalytic converter is in use over a prolonged period of time. The development in the catalytic converter art is in particular along the lines of maximizing the catalytically active surface area. Therefore in particular honeycomb bodies which have a large number of passages over their cross-section are used. Besides the possibility of increasing the surface area involved however the length and volume of the catalytic converter and therewith its cross-section are also increased. That however requires a large amount of space to be available for the catalytic converter in the exhaust gas system. In addition, with the catalytic converter being of an increasing size, the working processes for the production thereof become more expensive. In addition, in relation to large catalytic converters, particular attention must be paid to the durability thereof in relation to mechanical and thermal changes in operation, which necessitates a particular mounting configuration.

Set out hereinafter are various configurations of catalytic converters, to the features of which the present invention refers in respect of the configuration and form of the catalytic converter. Published, British Patent Application GB 2 231 283 A discloses a honeycomb body which has one layer. That layer is formed from a flat metal sheet and a structured metal sheet and is then shaped in a spiral to form a multi-layer catalytic converter. It has an internal cylindrical cross-section, the size of which is dependent on the outside diameter of the honeycomb body. The large number of mutually stabilizing layers which bear against each other is intended to ensure adequate stiffness for the honeycomb body constructed in that way. Published, Non-Prosecuted German Patent Application DE 37 15 040 A1 discloses another catalytic converter which contains a strip with non-cutting stampings therein. Those stampings are intended to increase the surface area involved. European Patent Application EP 0 473 081 A1 discloses mounting a catalytic converter in the bend of a motorcycle exhaust gas system. An apertured plate is used as the catalytic converter. The plate can be straight or also round. Published, Non-Prosecuted German Patent Application DE 24 36 559 Al in turn discloses a catalytic converter which is disposed directly in a bend of an internal combustion engine. The bend itself is in the form of a catalytic converter. Besides a catalytic coating on the inside wall of the bend, it is additionally possible to disposed catalytic shaped portions, in particular in screw form. Japanese Patent JP 61 65 940 discloses a catalytic converter which is made up of smooth and corrugated metal foils. Disposed upstream of that full catalytic converter is a further catalytic converter which is heatable. U.S. Pat. No. 4,195,063 in turn discloses a main catalytic converter with an additional, upstream-disposed catalytic converter. The catalytic converter contains primarily two catalytically coated mesh configurations that are each held between two mesh carriers. The catalytic converter can be disposed in the bend, but also in a conical configuration. Japanese Patent JP 61 096 120 discloses two tubes which are mounted in the proximity of an engine block in a curved configuration. The interior of the two tubes has holes. A catalytically active layer is disposed between those two tubes.

A particularly preferred area of use of a catalytic converter according to the invention is in relation to small engines. The term small engines is used hereinafter to denote engines with a cubic capacity of less than 250 cc. Such engines are used in particular in lawnmowers, motor-driven saws, transportable power generators, two-wheelers and similar uses. In the case of motor-driven saws, lawnmowers and other garden equipment the person operating the apparatus is often disposed over a prolonged period of time directly in the exhaust gas region of the small engine, and for that reason catalytic exhaust gas cleaning is particularly important there.

Attention is also directed to Published, Non-Prosecuted German Patent Application DE 38 29 668 A1 in which the catalytic converter, in a small engine, is used in a partitioning wall which extends approximately perpendicularly to the through-flow direction. European Patent EP 0 470 113 B1 also discloses a configuration of the catalytic converter, in which it is disposed with a spacing at all sides in an exhaust gas silencer or muffler for two-stroke engines. European Patent EP 0 049 489 B1 also discloses a process for the production of a carrier matrix for an exhaust gas catalytic converter. The features disclosed in those three documents can also be applied to this invention.

SUMMARY OF THE INVENTION

It is accordingly an object of the invention to provide a honeycomb body with a cross-sectional region which is bordered in the interior, in particular for small engines that overcome the above-mentioned disadvantages of the prior art devices and methods of this general type, which can be produced in a small number of working steps, which is extremely compact, and which nonetheless makes available a sufficient catalytically active surface area so that limit values which are prescribed by statute in respect of the exhaust gas characteristics of an internal combustion engine are observed. A further object of the invention is to provide a housing for the catalytic converter, which does not nullify again the space gained by virtue of the compact catalytic converter. Another object of the invention is to provide a process for the production of a compact catalytic converter carrier body, which ensures continuous production thereof while avoiding a high level of production expenditure.

With the foregoing and other objects in view there is provided, in accordance with the invention, a catalytic converter assembly for an exhaust gas system of an internal combustion engine, including a small engine, the catalytic converter assembly including:

a housing having a cross-section with a cross-sectional area;

and a catalytic converter having at most two layers formed of sheets and disposed in the housing, the catalytic converter containing:

an at least partially curved elongated body; and at least one structured sheet having a structuring and a catalytically active material, the at least one structured sheet being wound on inclinedly around the at least partially curved elongated body and at least partially bears against the housing, the structuring of the at least one structured sheet in addition with one of the housing and a sheet of a layer of the at most two layers define closed passages there-between through which exhaust gases can flow and such that, as considered over the cross-section of the housing, a cross-sectional area bordered in by the closed passages constitutes at least half of a total of the cross-sectional area of the housing and defines a bordered-in cross-sectional area.

A catalytic converter in a housing for an exhaust gas system of an internal combustion engine, in particular a small engine, has at least one structured metal sheet provided with a catalytically active material. The sheet is twisted or wound, it forms passages through which an exhaust gas can flow, and it at least partially bears against the housing. The sheet is of such a structuring that, as considered over a cross-section of the housing, the cross-sectional area which is enclosed or bordered by closed passages constitutes at least half of the total cross-section of the housing, with the catalytic converter having at most two layers. Restricting the catalytic converter to a maximum of two layers makes it possible to achieve an extremely compact catalytic converter that requires a small amount of space. For that purpose it is desirable for the structuring of the sheet to be such, in terms of utilization of space, that, besides the passage effect of the catalytic converter, there is also sufficient catalytically active surface area available. The use of a maximum of two layers also facilitates heating of the catalytic converter to its useful or operating temperature as it involves less mass to be heated than other catalytic converters of an expensive and complicated construction. In addition the limitation to a maximum of two layers has proven to be advantageous in order to impart to the catalytic converter, besides flexibility, also a high level of stability and rigidity in respect of shape. The catalytic converter affords an at least satisfactory catalytic conversion effect for the exhaust gases, for the preferred uses in the small-engine sector. An improvement in catalytic conversion is achieved if the bordered cross-sectional area constitutes at least two-thirds of the total cross-section of the housing. If the sheet provided with catalytically active material is twisted or wound in such a way that the structuring comes to lie in mutually opposite relationship, that provides that the enclosed cross-sectional area defined by the passages is disposed in a region around the center point of the catalytic converter while the center point is disposed within a remaining area which is not completely provided with passages. That can be achieved for flattened cross-sectional regions of the catalytic converter, as well as round, oval or polygonal catalytic converters. Concentration of the bordered cross-sectional area around the center point makes it possible for the outside passage surfaces which face towards the center point also to be fully acted upon by exhaust gas. In addition the structuring of the maximum of two layers can then be particularly advantageously such that the flow resistance in relation to the passages formed is no greater than that of the cross-section which does not completely involve passages.

An embodiment of the catalytic converter provides that the mutually oppositely disposed structurings are intertwined or interlaced without touching each other. In that way a quasi-passage-like geometry is imparted to the area which remains free. The mutually oppositely disposed structuring makes it possible for the bordered cross-sectional area to make up at least three-quarters of the total cross-sectional area of the housing.

It is precisely in connection with small implements and apparatuses that under some circumstances have to be moved manually that it is important for them to be of small dimensions and low weight, from the point of view of construction thereof. The catalytic converter can contribute thereto by having a stabilizing reinforcement. The reinforcement ensures that the catalytic converter enjoys its rigidity in respect of shape without excessively limiting it in regard to its elasticity. The stabilizing reinforcement can also be so configured that it performs a load-bearing function for the small implement or apparatus. By virtue of that configuration the catalytic converter can be fully integrated into same. The housing and the catalytic converter are then in a position of also being incorporated in the detailing and interpretation of the torsional stiffness and structural engineering involved.

A catalytic converter which is particularly capable of resisting impacts, vibration and jarring is afforded by each passage-forming sheet of the catalytic converter bearing against a reinforcement. The resistance in this respect can be further increased by the passage-forming sheet which has a top side and an underside bearing respectively with the top side and the underside against the reinforcement. Another possibility of producing a catalytic converter having a high level of stability in respect of shape but also a high degree of elasticity involves constructing a layer thereof with an unstructured sheet and a structured sheet. It can be combined with the stabilizing reinforcement. A preferred embodiment of a catalytic converter has an unstructured sheet with a top side and an underside, wherein a respective structured sheet is disposed at each of the top side and the underside respectively. The structuring is in particular a corrugation configuration, a curvature configuration, a scalloping or a folding configuration of the sheet. It may also have microstructures as well as small incisions and openings. The catalytically active surface area can also be increased in that way. In regard to the structuring, nature and form of the layer, attention is directed in particular to European Patent EP 0 484 364 B1, International Patent Application WO 93/20339, European Patent EP 0 152 560 B1 and Published, Non-Prosecuted German Patent Application DE 29 611 143.

Making up the catalytic converter from three sheets which are joined together, wherein the outermost one is structured, affords the possibility of the catalytic converter being held in a housing solely by virtue of a clamping force of that outer sheet. Such a holding action is facilitated if at least a part of a layer of the catalytic converter is flexible. That is in particular a part of the layer, which is supported against the reinforcement, in particular a wall of the housing or the small apparatus or implement or the internal combustion engine.

In a further embodiment, to achieve a high level of stability for the catalytic converter, it has the configuration of a layer with a first metal sheet and a second metal sheet. In that configuration the first sheet is preferably thicker than the second sheet by a factor of between 1.5 and 5, in particular between 2 and 4. When using metal foils of between 20 $\mu$ and 100 $\mu$m, it makes it possible to use the thinner foil that is particularly desirable in terms of a structuring, without having to abandon the idea of a self-stabilizing catalytic converter. It is therefore preferable for the first sheet to be unstructured and for the second sheet to be structured. A further embodiment of the catalytic converter provides the catalytic converter with a flattened cross-section. If the directions in which the forces which are applied from the outside will act on the catalytic converter are known, then with a flattened cross-section it is possible to provide a catalytic converter which enjoys particular stability in that direction. The catalytic converter can also be of such a configuration that it has preferred directions in respect of the effect of external forces, in which directions the catalytic converter reacts elastically and possibly also necessarily plastically. Destruction of the catalytic converter can be prevented by virtue of established regions of the catalytic converter that, in the event of an excessively heavy loading, involve plastic deformation in order to receive and adsorb the forces acting.

The catalytic converter can be disposed in an exhaust gas system that in internal combustion engines usually leads away therefrom. Equally however the catalytic converter can also be used in exhaust gas systems which are disposed in the casing of the internal combustion engine. For both situations it is desirable for the housing of the catalytic converter to be part of the exhaust gas system. That can ensure dissipation of heat of the catalytic converter as it heats up by flow transfer to the exterior. The housing can be a bend tube or a component of a silencer or muffler of the exhaust gas system. That ensures compact installation of the catalytic converter without an additional space being required for same.

In accordance with a further aspect of the invention, in order to make compact utilization of the space involved, a silencer or muffler for an exhaust gas system of an internal combustion engine, in particular a small engine, is used by the silencer or muffler having a device for receiving the above-described catalytic converter. That is for example a suitably configured and in particular adapted housing which facilitates disposing the catalytic converter therein and its fixing thereat. That can be achieved by a tubular casing as the housing as well as by virtue of a suitable spatial configuration in the casing of the internal combustion engine. Particularly in the case of small engines, the silencer/catalytic converter combination makes it possible to keep the exhaust gas systems thereof small.

It is preferable for a part of the silencer or muffler to have means for fixing the catalytic converter. That can be teeth, notches, transverse web portions, channels, grooves or similar structural formations. If teeth or the like are used they co-operate with at least the oppositely disposed sheet. Teeth engage into same and thereby hold the entire catalytic converter.

The service life of the catalytic converter also depends on the respective mode of operation of the internal combustion engine and the area of use thereof. If the engine is only ever repeatedly operated for a short period of time, and if the engine is subjected to large forces acting thereon from the exterior, all that reduces the service life of the catalytic converter.

It is therefore desirable for the catalytic converter to be interchangeably fitted in position. In the case of the silencer or muffler the catalytic converter can for example be disposed in a top housing and a bottom housing. One of the two housing halves preferably has a reinforcement by which a force, in particular a clamping force, can be exerted on the catalytic converter. The reinforcement can be a transverse web or bar portion in the silencer or muffler, as well as one of the sound-damping structures of the silencer or muffler. A further possible way of holding the catalytic converter in the silencer or muffler involves so squeezing at least a part of the catalytic converter in the silencer or muffler that the catalytic converter is immovable. A further embodiment of a silencer or muffler that is particularly suitable for small engines has at least two parts, a top housing and a bottom housing. A partitioning wall divides the silencer or muffler into a first region and a second region. The partitioning wall and/or the silencer or muffler has ways for holding the catalytic converter in each respective ones of the regions that are separated from each other. It is possible in that way for two catalytic converters to be disposed in one silencer or muffler. That is not necessarily the case. There may also be only a single one or also more than two catalytic converters.

In accordance with a further concept of the invention there is also provided a process for the production of a catalytic converter carrier body which is disposed in an exhaust gas system of an internal combustion engine, in particular a silencer or muffler of a small engine. The process includes:

a) a structured sheet is wound on inclinedly around an at least partially curved elongate body;

b) subsequently at least a part of the elongate body with the sheet wound thereon is cut into a plurality of portions; and c) a respective portion becomes a catalytic converter carrier body.

That process is particularly suitable for a continuous production procedure, wherein the structured sheet can be unwound from an endless strip. The elongate body in turn can be a tube or also another suitably long available body. To provide for a particularly high degree of utilization of space in order to afford a large catalytically active surface area the body has a hollow interior in which a further structured sheet is disposed. The catalytically active surface is then afforded by the sheet and/or the body being coated with a catalytically active layer prior to the winding-on operation or by the portion which has been cut off being coated with a catalytically active layer after the cutting operation. Depending on the respective way in which the sheets are fixed together, that can be effected by soldering, welding, adhesive or similar methods but equally also by inherent stressing of one of the sheets, the moment when the catalytically active layer is most appropriately to be applied is a matter of choice.

To achieve a high degree of stability of the above-mentioned portion, it is provided that the body is a metal sheet that is thicker than the sheet that is to be wound on. Desirable values in respect of stability are achieved if the thicker sheet is about one to five times thicker than the sheet that is to be wound on. As described above a compact catalytic converter can be particularly inexpensively produced from the catalytic converter carrier body, in accordance with this method.

Other features which are considered as characteristic for the invention are set forth in the appended claims.

Although the invention is illustrated and described herein as embodied in a honeycomb body with a cross-sectional region which is bordered in the interior, in particular for small engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
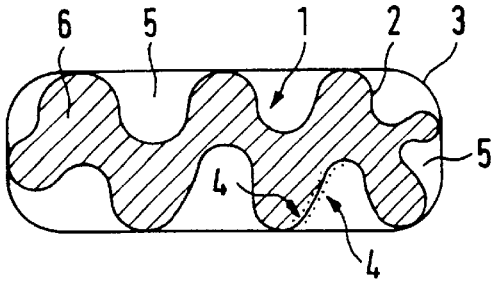
FIG. 1 is a diagrammatic, sectional view of a structured sheet in a housing.

In all the figures of the drawing, sub-features and integral parts that correspond to one another bear the same reference symbol in each case. Referring now to the figures of the drawing in detail and first, particularly, to FIG. 1 thereof, there is shown a catalytic converter 1 that has a metal sheet 2. The sheet 2 is disposed in a housing 3 of an exhaust gas system and has a catalytic coating 4. The sheet 2 is structured. The structure is a corrugation configuration. This makes it possible for the sheet 2 also to be disposed under its inherent stress in the housing 3. That inherent stress is sufficient to fix the catalytic converter 1 in the housing 3. The structuring of the sheet 2 is so selected that passages 5 are formed by co-operation with the housing 3. The passages 5 embrace a part of the total cross-sectional area, to constitute a bordered-in cross-sectional area. A remaining area 6 in the housing 3, which is not enclosed by the passages, is less than 50% of the total housing cross-section illustrated, by virtue of the corrugation configuration. That area 6 is emphasized by hatching to show it more clearly.

Figure 2:
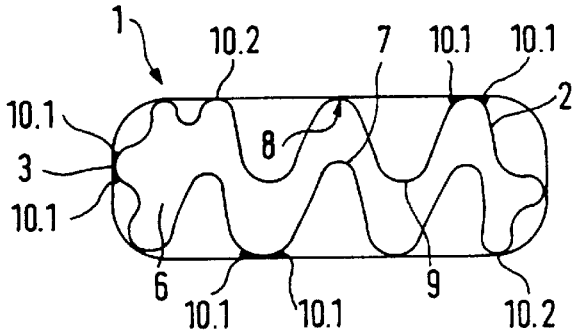
FIG. 2 is a sectional view of a second embodiment of the structured sheet in the housing.

FIG. 2 again shows the structured sheet 2 forming the catalytic converter 1 in the housing 3. The sheet 2 has a corrugated structure that is so selected that a first corrugation crest 7 engages into an oppositely disposed first corrugation trough 8. That leads on the one hand to a further reduction in the area 6 and thus an increase in the bordered cross-sectional area. On the other hand the first corrugation crest 7 is intertwined or interlaced in non-contacting relationship with a second corrugation crest 9. Thus, in relation to forces acting thereon from the exterior, the catalytic converter 1 can react elastically by virtue of the fact that the spacing between the first corrugation crest 7 and the second corrugation crest 9 is available as a clearance. The elasticity characteristics of the catalytic converter 1 can be influenced by the nature of the connection of the sheet 2 to the housing 3. If only for example each of the second corrugation troughs is connected to the housing 3, as is indicated by connecting locations 10, the catalytic converter 1 admittedly remains fixed, but it is nonetheless movably held in the housing 3. In that respect the connecting locations 10 may extend over the entire axial length of the catalytic converter 1, but equally it may be present only in a point-wise or portion-wise manner. That is indicated by connecting locations 10.1 which occur as solder locations on both sides of a corrugation trough and which there extend in the axial direction of the catalytic converter. In contrast connecting locations 10.2 are for example to be considered as spot or longitudinal welds.

Figure 3:
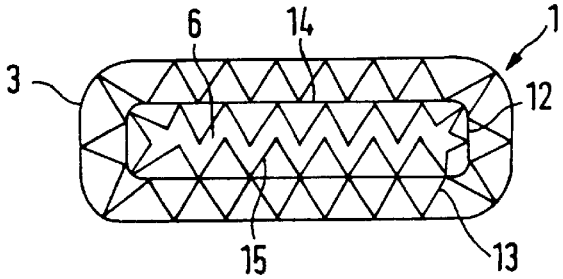
FIG. 3 is a sectional view of a catalytic converter with one and a half layers in the housing.

FIG. 3 shows another preferred embodiment of the catalytic converter 1, involving one and a half layers, in the housing 3. One layer 11 is formed from a first sheet 12 and a second sheet 13. The first sheet 12 is unstructured. The second sheet 13 has a folded configuration as the structuring. The layer 11 is wound in such a way as to form a closed body 14. Disposed in the closed body 14 is a third sheet 15, which is supported at the first sheet 12 with its structuring. The area 6 that does not involve passages is once again considerably reduced by virtue of the third sheet 15. At the same time it additionally makes catalytically active surfaces available. To achieve a particular degree of elasticity but also strength of the catalytic converter 1, the unstructured first sheet 12 is thicker than the second sheet 13 and the third sheet 15. The two structured sheets 13 and 15 therefore find with the first sheet 12 a static counterpart in relation to the housing 3.

Figure 4:
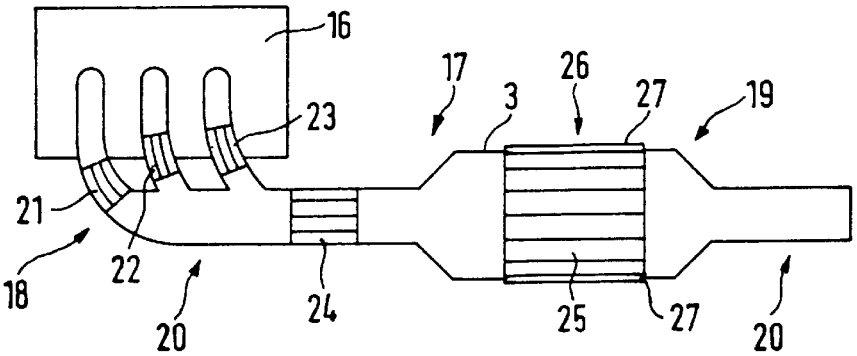
FIG. 4 is a side-elevational view of a number of configurations of the catalytic converters in an internal combustion engine exhaust gas system.

FIG. 4 shows an internal combustion engine 16 to which an exhaust gas system 17 is connected. The exhaust gas system 17 has a bend region 18, a silencer or muffler 19 and connecting pipes 20. Disposed in the bend region 18 are a first catalytic converter 21, a second catalytic converter 22 and a third catalytic converter 23, each disposed in a respective pipe leading away from a cylinder. The first catalytic converter 21 is of a conical configuration, and the second catalytic converter 22 likewise. The third catalytic converter 23 in contrast has a bend, with its cross-section remaining substantially constant. A fourth catalytic converter 24 is disposed in the connecting pipe 20. It is of a regular cross-section that does not change over its axial length. A fifth catalytic converter 25 is also disposed in the silencer or muffler 19. The catalytic converter 25 is adapted to the housing 3 and vice versa. For that purpose the silencer or muffler 19 has a holding device 26, such as for example an outwardly projecting portion or bulge portion 27. By virtue of its size the catalytic converter 25 is a precise fit into the portion 27. By virtue of that configuration it is possible for the fifth catalytic converter 25 to be held in the silencer or muffler 19 solely by virtue of its inherent stress, in conjunction with the portion 27.

Figure 5:
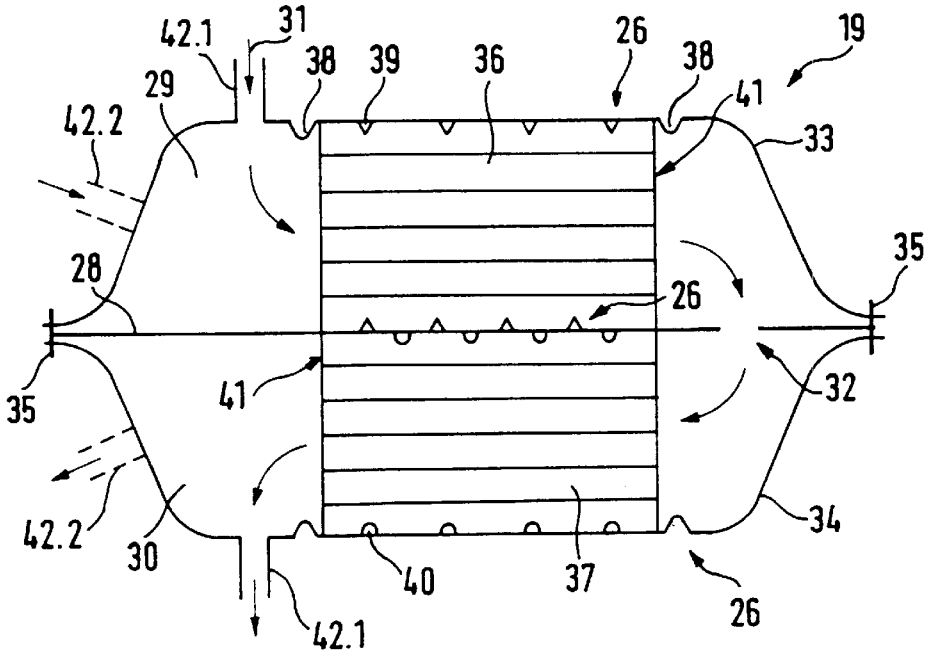
FIG. 5 is a side-elevational view of a configuration of two catalysts in a silencer or muffler.

FIG. 5 shows another embodiment of the silencer or muffler 19. It is divided in its interior by a partitioning wall 28 into an upper region 29 and a lower region 30. A flow communication between the upper region 29 and the lower region 30, for an exhaust gas flow 31 passing through the silencer or muffler 19, is ensured by aperture device 32 in the partitioning wall 28. The silencer or muffler 19 has a top housing 33 and a bottom housing 34 that can be fixed together with the partitioning wall 28 by a connector 35. The partitioning wall 28, the top housing 33 and the bottom housing 34 have the holding device 26 for the upper catalytic converter 36 and the lower catalytic converter 37 disposed in the silencer or muffler 19. The holding device 26 is for example grooves 38, teeth 39 or also transverse web or bar portions 40. They come into contact at least with the respectively outwardly disposed sheet of the upper catalytic converter 36 and the lower catalytic converter 37. The one or more holding devices 26 can also be disposed in such a way that at least a part of an end face 41 of the upper catalytic converter 36 and/or the lower catalytic converter 37 is used for fixing purposes. The illustrated silencer or muffler 19 is extremely compact and is preferably intended for use in particular in relation to small engines. The exhaust gas connections 42.1, 42.2 provided for the exhaust gas flow 31 can be disposed in different ways depending on the respective position of installation of the silencer or muffler 19. While the exhaust gas connections 42.1 are suitable for connection in an exhaust gas system extending in a straight line, the exhaust gas connections 42.2 are fitted to the silencer or muffler 19 in sideways relationship. That affords an advantage in terms of flow dynamics as the change in direction to the upper catalytic converter 36 or the change in direction from the lower catalytic converter 37 to the exhaust gas connection 42 no longer occurs.

Figure 6:
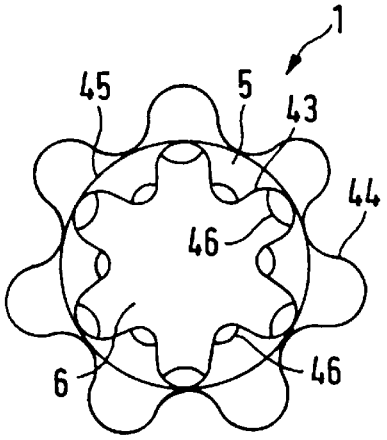
FIG. 6 is a sectional view a further embodiment of the catalytic converter having one and a half layers.

FIG. 6 shows an embodiment of the catalytic converter 1 in a circular shape. It is of such a construction as to involve one and a half layers. It has two thicker structured sheets, an inner sheet 43 and an outer sheet 44. An unstructured sheet 45 is disposed between the inner sheet 43 and the outer sheet 44. A corrugation configuration was adopted as the structuring of the inner sheet 43 and the outer sheet 44. If the corrugation troughs and the corrugation crests respectively of the two structured sheets 43 and 44 are disposed at approximately the same spacing, the unstructured sheet 45 is capable of receiving forces acting on the configuration and absorbing the energy by virtue of elastic deformation. In addition the inner sheet 43 has additional half-structures 46. They subdivide the passages 5 that already exist or form passages in further cross-sectional regions of the otherwise free area 6. The half-structures 46 are formed for example by incisions in the inner sheet 43, in which case the material which has been cut into is displaced in an outward direction or an inward direction, in dependence on its position in the structure. Another possible way of providing holding structures 46 involves for example disposing additional sheet portions on the inner sheet 43. The use of half-structures or the like promotes passage formation over a large area in the catalytic converter 1, to achieve a small free area 6 and thus a large bordered cross-sectional area.

Figure 7:
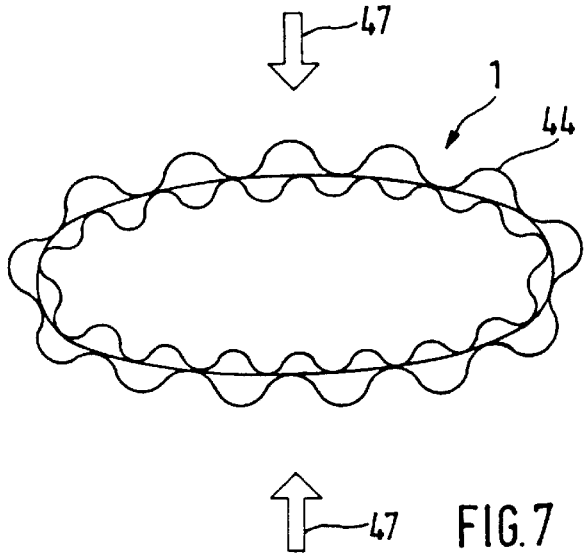
FIG. 7 is a sectional view of the catalytic converter having one and a half layers with forces acting thereon.

FIG. 7 also shows a catalytic converter 1 involving one and a half layers, on which external forces 47 are acting. The external forces 47 can be accommodated in operation of the catalytic converter 1 by deformation of the outer sheet 44. However they may also be applied for example deliberately in the production procedure in order to convert an otherwise round catalytic converter 1 into the catalytic converter 1 involving a flattened cross-sectional configuration. The external forces 47 can also be utilized in order to fit the catalytic converter 1 into the housing. It is then held therein by its inherently produced stresses.

Figure 8:
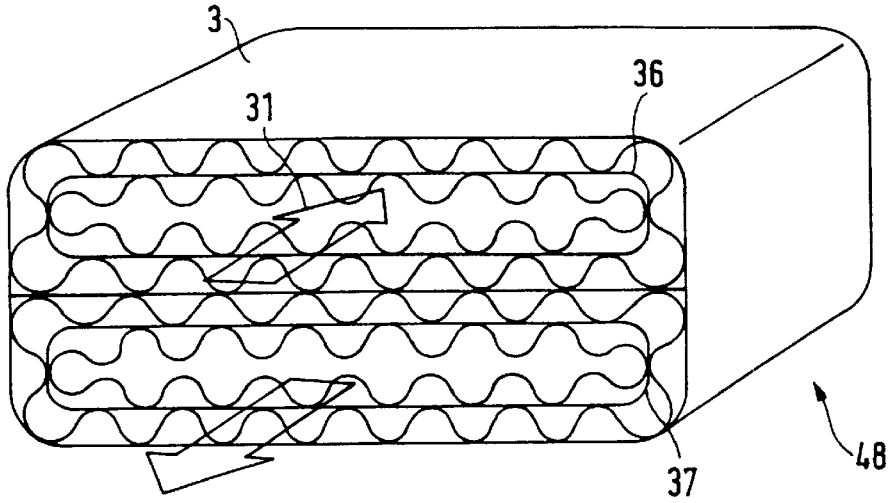
FIG. 8 is a perspective view of a further configuration of two catalytic converters in a housing of an exhaust gas system.

FIG. 8 shows an extremely compact configuration of the upper catalytic converter 36 and the lower catalytic converter 37 in the housing 3. Both of the catalytic converters 36 and 37 are adapted to the shape of the housing 3 and permit the exhaust gas flow 31 to flow axially there through. The exhaust gas flow can be guided in particular in such a way that it first flows through the upper catalytic converter 36 and then through the lower catalytic converter 37. The housing 3 with the two catalytic converters 36 and 37 is therefore to be disposed in a particularly space-saving configuration for example in the silencer or muffler. In addition, like the catalytic converters 36 and 37, it can also be provided with a catalytically active coating. That applies not only specifically in regard to the illustrated housing but also in regard to other housings. There are also other uses for a unit 48 formed in that way. As it is easy to fit in position and remove by virtue of its structure, it is suitable for example as a replacement part in exhaust gas systems of internal combustion engines. The catalytically active surface area that is necessary when high exhaust gas flow rates are involved is then afforded by the exhaust gases flowing in succession through the upper catalytic converter 36 and the lower catalytic converter 37. In that way it is also possible for a plurality of the units 48 to be disposed one after the other to clean the exhaust gas flow 31.

Figure 9:
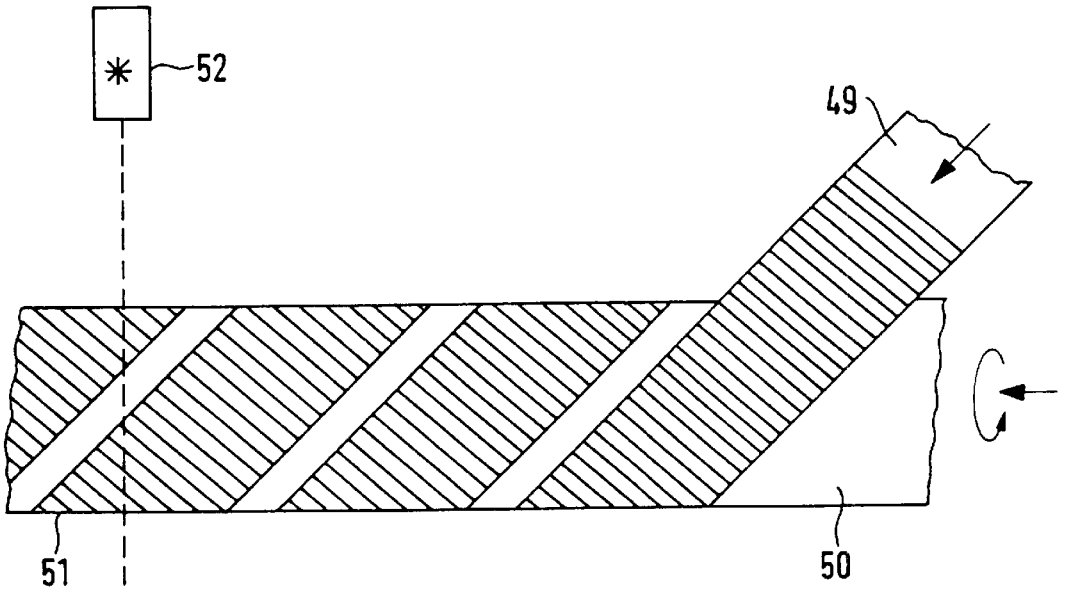
FIG. 9 is a fragmentary, plan view of a process for a production of a catalytic converter carrier body.

FIG. 9 shows a process for the production of a catalytic converter carrier body. A structured sheet 49 is inclinedly wound around an at least partially curved or cambered elongate body 50. The body 50 and the structured sheet 49 perform a relative movement for that purpose. That can be achieved for example by rotation of the body 50 and the advance movement thereof in such a way that the structured sheet 49 is drawn onto the body 50. That is indicated by the arrows on the sheet 49 and the body 50 respectively. In that operation the structured sheet 49 is connected to the body 50. Subsequently at least a part of the elongate body 50 with the sheet 49 wound thereon is divided up into a plurality of portions 51. A laser is used here as a cutting unit 52. It is capable of cleanly cutting the portions 51 off the body 50. The cutting operation can in particular be implemented in such a way that there is no need for after-treatment of the portion 51. The portion 51, as the then finished catalytic converter body, can then be used as the catalytic converter 1. For that purpose the portion 51 is either subsequently provided with a catalytically active coating or the sheet 49 and the body 50 respectively already have that coating, in the winding-on operation.

Figure 10:
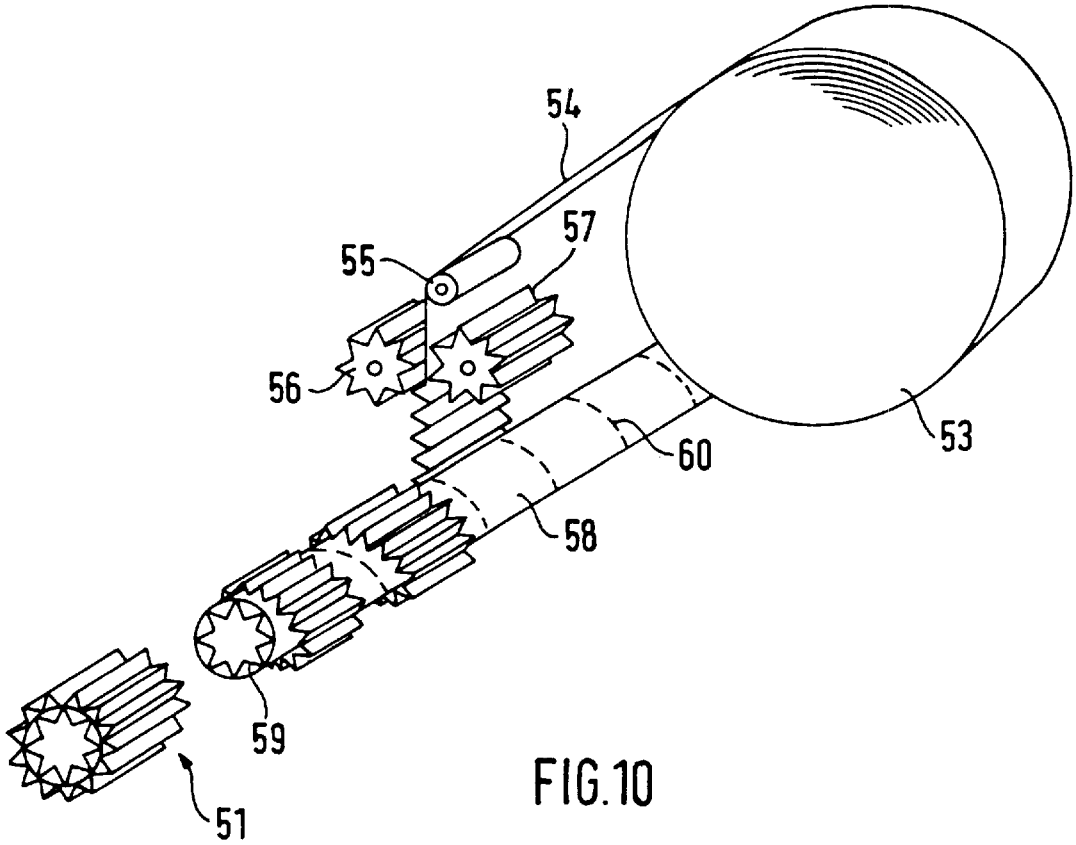
FIG. 10 is a perspective view of the production process corresponding to that shown in FIG. 9.

FIG. 10 shows a further production process for the catalytic converter carrier body. A sheet 54 provided with a catalytically active coating is guided from an endless roll 53 to a direction-changing roller 55. From there the sheet 54 is taken to a first profiling roller 56 which is in engagement with a second profiling roller 57. The flank geometry of the two profiling rollers 56, 57 defines the structuring of the sheet 54. It is then applied to a hollow body 58. The hollow body 58 has an internally disposed structured second sheet 59 that is also already provided with a catalytically active coating. The hollow body 58 and the second sheet 59 can be produced for example prior to application of the sheet 54 from a formed layer that is then inclinedly wound in mutual relationship. That winding effect is indicated by the broken line 60. The hollow body 58 however may also be a tube into which the second sheet 59 has been inserted. In a somewhat different process the structured second sheet 59 is not inserted prior to division of the portions 51 but only after they have been cut off.

Figure 11:
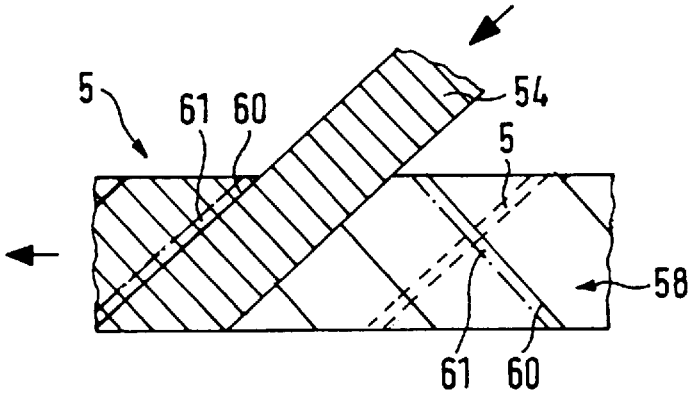
FIG. 11 is a fragmentary, plan view of a further production process of the catalytic converter.

FIG. 11 shows a further production process for the catalytic converter carrier body. In this case also the sheet 54 which is provided with a catalytically active coating is applied to the hollow body 58 from an endless roll 53 (not shown). The hollow body 58 is produced from a layer that is inclinedly wound with itself. The winding effect can be seen at the butt join 60 between adjacent regions of the wound layer. The winding operation in particular can be implemented in such a way that passages 5, which are here indicated in broken line, are not interrupted in terms of continuity thereof by the winding. The same also applies in regard to the passages 5 of the sheet 54 that is to be applied. The fact that the butt join 60 in the case of the sheet 54 to be applied is at an angle to that of the hollow body 58 results in that a catalytic converter carrier body produced in that way can be of a particularly stable configuration. An advantage of the angular relationship of the butt joins relative to each other is that the later catalytic converter carrier body does not have any axially extending peripheral seam or join. On the contrary the loading at the seam is distributed over the entire periphery. The operation of applying the sheet 54 may also be effected in such a way that the layer of the hollow body 58 is virtually effectively clamped. The connection between the sheet 54 and the hollow body 58 can be produced by soldering directly after the operation of applying the sheet or also only in a subsequent working step. It is possible for example for the sheet 54 also to be first glued on and later soldered. The same also applies in regard to the connection of the layer of the hollow body 58. In a somewhat different production process the hollow body 58 is again produced from a layer as shown in FIG. 11. This time however the layer is formed into the hollow body in such a way that there is an overlap region 61 as indicated in dash-dotted line. The overlap region 61 then stabilizes the hollow body 58. At the same time it can also be used to produce a connection or join. For that purpose, in one configuration, the overlap region 61 has an adhesive or primer to which solder material is then applied. A corresponding procedure is also adopted with the sheet 54 to be applied. The elongate hollow body 58 which is produced in that way, with the applied sheet 54, is raised to suitable temperatures as a whole in a soldering oven so that the solder material produces a durable connection in the overlap region 61. In that case the connection of the hollow body 58 to the applied sheet 54 is also produced by soldering. It is only thereafter that individual portions 51 are cut off.

Figure 12:
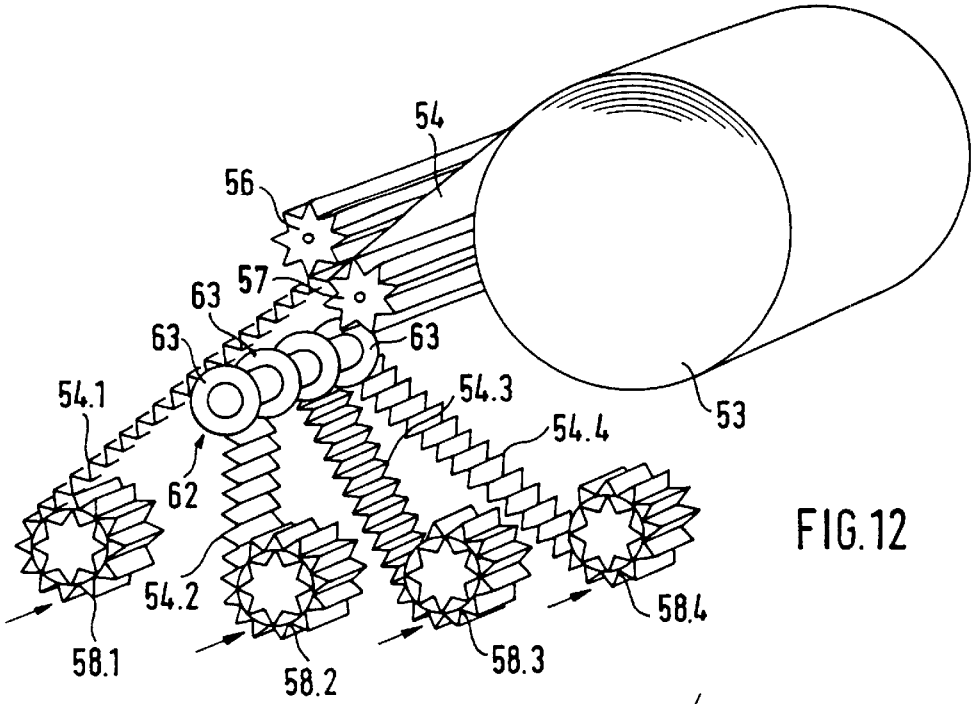
FIG. 12 is a perspective view of a configuration for an alternative production process corresponding to that shown in FIG. 11.

FIG. 12 shows a process with which for example the catalytic converter carrier body described with reference to FIG. 11 can be produced. From the endless roll 53 the sheet 54 which is still wide is passed to the first profiling roller 56 and the second profiling roller 57. After the profiling operation the sheet 54 is cut up into four individual sheets 54.1, 54.2, 54.3 and 54.4. That is effected by the cutting device 62 which has severing blades 63. From there the severed sheets 54.1 to 54.4 pass to respective hollow bodies 58.1 to 58.4. They are each wound onto a respective one thereof. The forward feed direction of the hollow bodies 58.1 to 58.4 is indicated by the respective arrows. The production process illustrated is suitable for a continuous working procedure as the hollow bodies 58.1 to 58.4 can also be continuously produced in a similar manner in an upstream-disposed station.

Figure 13:
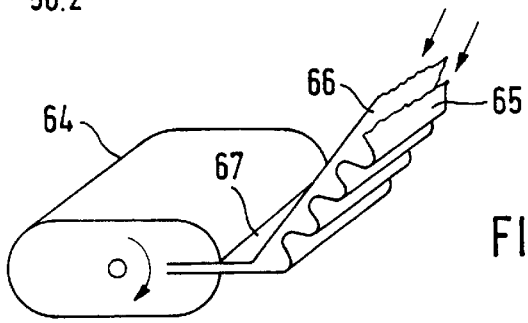
FIG. 13 is a perspective view of another production process.

FIG. 13 also shows a production process for the catalytic converter 1. A structured sheet 65 and an unstructured sheet 66 are introduced into a rotary body 64, as in the case of a sardine can opener, into a slot 67 in the rotary body 64. When the rotary body 64 is rotated the two sheets 65, 66 are wound on in the form of a layer. The shape of the catalytic converter 1 produced in that way is dependent on the geometry of the rotary body 64. The cavity which is formed in the interior of the catalytic converter 1 produced in that way can be more likely large or also kept small, depending on the respective requirements involved. An additional, in particular structured sheet can also be introduced into that cavity. In such a development of the process for the production of the catalytic converter 1 the rotary body 64 can be left therein and then serves as stabilization, by virtue of the thickness of its material.

Figure 14:
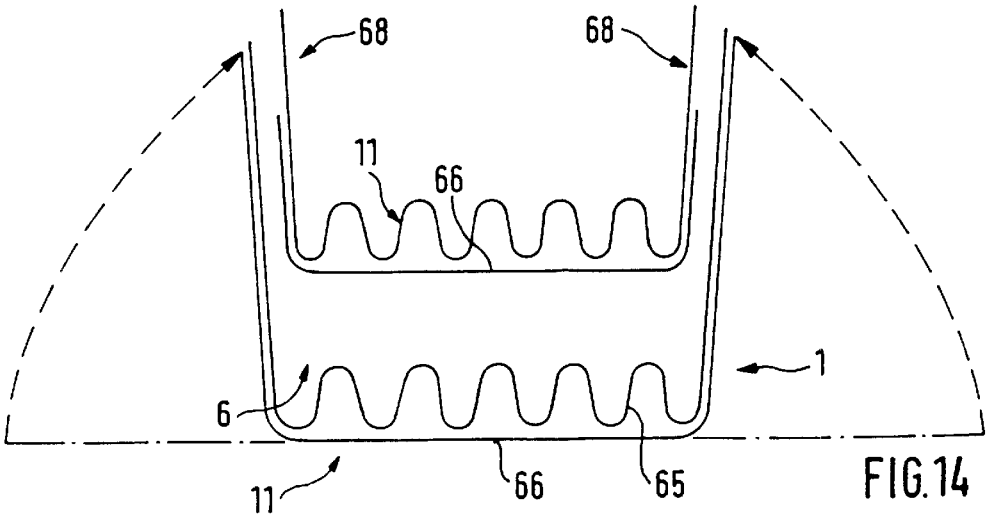
FIG. 14 is a sectional view of still another production process.

FIG. 14 shows another production process for the catalytic converter 1. The catalytic converter 1 is produced by the structured sheets 65 and the unstructured sheets 66 being stacked one upon the other. In that way the catalytic converter 1 has at most two layers 11 with the area 6 which is not bordered-in in its interior and which is defined by surrounding passages, in a closed configuration. Ends 68 of the structured and unstructured sheets 65, 66 project beyond the actual subsequent catalytic converter 1 and are bent over in the direction indicated by the arrows so as to form a casing around the catalytic converter 1. For that purpose the operation of bending the ends 68 is advantageously effected not only for a single sheet but for all sheets jointly in one working step. This is irrespective of whether the sheets involved are the structured sheets 65 or unstructured sheets 66. An advantageous process for that purpose is firstly stacking the structured sheets 65 and the unstructured sheets 66 without folding over the ends 68. It is only then that the ends 68 are folded over. This can be in one direction, but it can also be in mutually opposite directions. For that purpose the entire stack can be turned round or shaping devices engage the ends 68 at the outside and bend them over.

Figure 15:
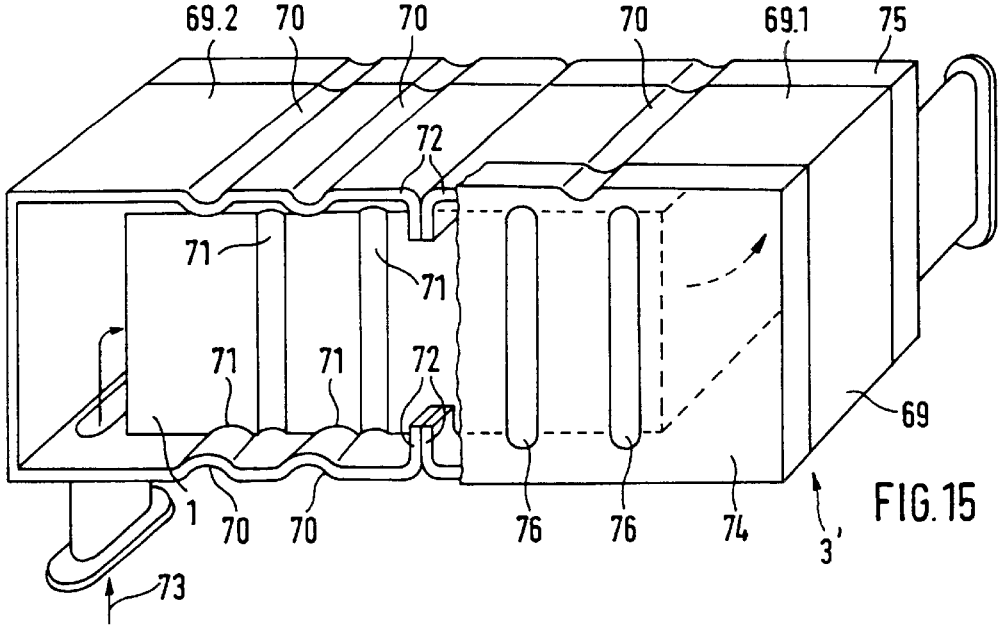
FIG. 15 is a perspective view of a further housing for the catalytic converter.

FIG. 15 shows a further housing 3' for the catalytic converter 1. The housing 3' can be used as a silencer or muffler housing. It has a base body 69 with inwardly extending corrugation portions 70 which are of such a configuration that they engage into corresponding recesses 71 in the catalytic converter 1 which is disposed in the interior of the housing 3', and thus fix it in position. The base body 69 contains a first part 69.1 and a second part 69.2 which each has a bent-over end 72. The bent-over ends 72 can be joined together, for example by a welded seam or by soldering. That then provides a one-piece base body 69. Otherwise it is in two pieces, in which case it is then held together in co-operative relationship by engagement of the ends 68 into the catalyst 1. A first cover 74 and a second cover 75 are disposed on the base body 69 for laterally covering over the assembly and preventing a discharge flow of a gas flow 73 which is passing through the catalytic converter 1. Disposed in the first cover 74 are inward curvature portions 76 that engage into corresponding recesses 71 in the catalytic converter 1. The catalytic converter 1 is laterally fixed in that way. That method of closing the housing 3' by use of covers which are to be mounted at the sides permits the catalytic converter 1 to be replaceable by inserting into and removing it from the base housing 69.

Figure 16:
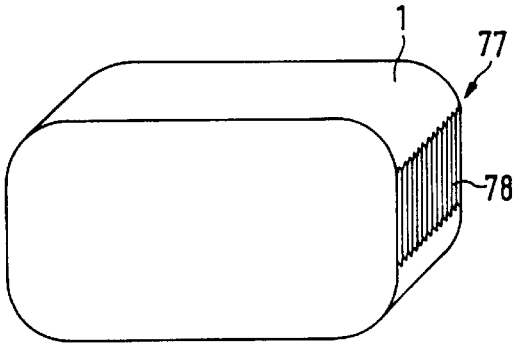
FIG. 16 is a perspective view of an embodiment of an outside surface of the catalytic converter.

FIG. 16 shows an embodiment of an outside surface 77 of the catalytic converter 1. The outside surface 77 is profiled and thereby prevents undesired displacement of the catalytic converter 1 in the housing that is not shown here. The profiling 78 can be non-directional or random, or oriented. At any event the profiling 78 provides that the catalytic converter 1 is prevented from being slowly pushed out of the housing, for example by virtue of vibration. An inclined tooth-like profiling has proven to be advantageous. On the one hand this configuration can be so oriented that there is a preferential direction in terms of preventing displacement of the catalytic converter in the housing. For example attaching a mechanical stop configuration to the housing in relation to the direction which is opposite to that preferential direction ensures that removal of the catalytic converter 1 from the housing is possible only after the way has been cleared by the mechanical stop configuration. Not only can the catalytic converter 1 but also the housing 3 or the silencer or muffler 19 itself may have a profiling configuration as just described above.

Figure 17:
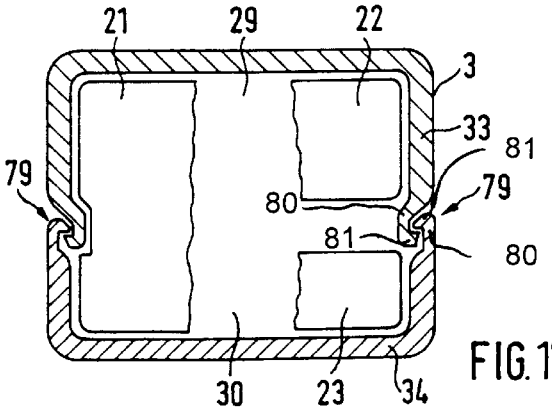
FIG. 17 is a sectional view of a still further configuration of the catalytic converters in another housing.

FIG. 17 shows a possible configuration of the first catalytic converter 21, the second catalytic converter 22 and the third catalytic converter 23 in the housing 3. The housing 3, for example the silencer or muffler 19, has the top housing 33 and the bottom housing 34. The top housing 33 is closed and held to the bottom housing 34 by way of a mutually engaging closure mechanism 79. End regions 80 of walls of the top housing 33 and the bottom housing 34 respectively also form a kind of hook 81. The hooks 81 are of such a configuration that, when the top housing 33 is pressed onto the bottom housing 34, the end regions 80 of the top housing 33 are urged inwardly and the end regions 80 of the bottom housing 34 are urged outwardly. In that way then the hooks 81 which are disposed in mutually opposite relationship can engage one into the other. The internal configuration of the housing 3 can be used in different ways for the catalytic converter or converters 21, 22 and 23 which are to be disposed therein. While the first catalytic converter 21 which is shown in section is disposed alone in the housing 3, the configuration of the second catalytic converter 22 and the third catalytic converter shows how the three-dimensional geometry of the top housing 33 and the bottom housing 34 with the hook configurations thereof is utilized for holding a respective one of the two catalytic converters in the upper region 29 and the lower region 30 respectively. In the case of the first catalytic converter 21 in contrast a part of the closure mechanism 79 engages into the catalytic converter 21 itself and thus fixes it in the housing 3.

Figure 18:
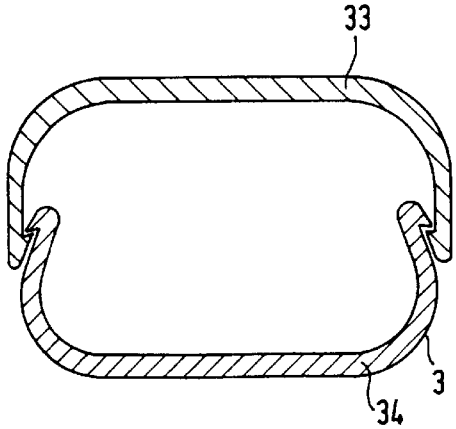
FIG. 18 is a sectional view of a further housing.

FIG. 18 again shows the housing 3. The housing 3 again has the top housing 33 and the bottom housing 34, wherein they are of such a configuration that they fix the catalytic converter or converters to be disposed in the interior thereof, by virtue of the shape thereof. The catalytic converter itself can therefore be not only of a more or less quadrangular configuration but equally can also be concave or convex. Further shapes are also possible, whether hexagonal or other polygonal configurations as well as curved or other complicated geometries.

The present invention provides in particular a catalytic converter and a process for the production of a catalytic converter carrier body from which that catalytic converter can be produced, which is of a simple compact structure while nonetheless being effectively useful in respect of its exhaust gas cleaning characteristics. A preferred area of use of a catalytic converter of this kind is in connection with small engines.

We claim:

1. A catalytic converter assembly for an exhaust gas system of an internal combustion engine, the catalytic converter assembly comprising:

a housing having a cross-section with a cross-sectional area;

a catalytic converter having at most two layers formed of sheets and disposed in said housing, said catalytic converter including:

at least partially curved elongated body; and at least one sheet of said sheets being a structured sheet having a structuring and a catalytically active material, said at least one structured sheet being wound on inclinedly around said at least partially curved elongated body and at least partially bears against said housing, said structuring of said at least one structured sheet in addition with one of said housing and a sheet of a layer of said at most two layers define closed passages there-between through which exhaust gases can flow and such that, as considered over said cross-section of said housing, a cross-sectional area bordered in by said closed passages constitutes at least half of a total of said cross-sectional area of said housing and defines a bordered-in cross-sectional area.

2. A catalytic converter assembly for an exhaust gas system of an internal combustion engine, the catalytic converter assembly comprising:

a housing having a cross-section with a cross-sectional area; and a catalytic converter formed of at most two layers with sheets and disposed in said housing, said catalytic converter having at least one sheet of said sheets being a structured sheet with a structuring and a catalytically active material, said at least one structured sheet being wound so that said structuring come to lie in mutually opposite relationship and said at least one structured sheet at least partially bears against said housing, said structuring of said at least one structured sheet in addition with one of said housing and a sheet of a layer of said at most two layers define closed passages there-between through which exhaust gases can flow and such that, as considered over said cross-section of said housing, a cross-sectional area bordered in by said closed passages constitutes at least half of a total of said cross-sectional area of said housing and defines a bordered-in cross-sectional area.

3. A catalytic converter assembly for an exhaust gas system of an internal combustion engine, the catalytic converter assembly comprising:

a housing having a cross-section with a cross-sectional area; and a catalytic converter formed of at most two layers with sheets and disposed in said housing, said catalytic converter including:

a sheet having a thickness;

at least one sheet of said sheets being a structured sheet having a structuring, a catalytically active material and a given thickness, said at least one structured sheet and said sheet forming a layer of said at most two layers, said layer being wound and said at least one structured sheet at least partially bears against said housing, said structuring of said at least one structured sheet in addition with one of said housing and said sheet of said layer of said at most two layers define closed passages there-between through which exhaust gases can flow and such that, as considered over said cross-section of said housing, a cross-sectional area which is bordered in by said closed passages constitutes at least half of a total of said cross-sectional area of said housing and defines a bordered-in cross-sectional area; and said thickness of said sheet being thicker than said given thickness of said at least one structured sheet by a factor of between 1.5 and 5.

4. The catalytic converter assembly according to claim 1, wherein said bordered-in cross-sectional area constitutes at least two-thirds of said total of said cross-sectional area of said housing.

5. The catalytic converter assembly according to claim 1, wherein said at least one structured sheet is so wound that said structuring comes to lie in mutually opposite relationship and defines oppositely disposed structurings.

6. The catalytic converter assembly according to claim 5, wherein said oppositely disposed structurings are interlaced with each other without touching each other.

7. The catalytic converter assembly according to claim 5, wherein said bordered-in cross-sectional area constitutes at least three-quarters of said total of said cross-sectional area of said housing.

8. The catalytic converter assembly according to claim 1, wherein at least one of said housing and said catalytic converter has a stabilizing reinforcement.

9. The catalytic converter assembly according to claim 8, wherein said at least one structured sheet forming said closed passages of said catalytic converter bears against said stabilizing reinforcement.

10. The catalytic converter assembly according to claim 8, wherein said at least one structured sheet forming said closed passages of said catalytic converter has a top side and an underside, said top side and said underside of said at least one structured sheet each bear against a respective stabilizing reinforcement.

11. The catalytic converter assembly according to claim 1, wherein said at most two layers include a layer with an unstructured sheet and said at least one structured sheet.

12. The catalytic converter assembly according to claim 1, wherein said catalytic converter has an unstructured sheet with a top side and an underside, and a respective structured sheet is disposed at each of said top side and said underside of said unstructured sheet.

13. The catalytic converter assembly according to claim 1, wherein said structuring is a structuring selected from the group consisting of a corrugation configuration, a bend configuration and a scallop configuration.

14. The catalytic converter assembly according to claim 8, wherein said at most two layers include a layer and at least a part of said layer is flexible and bears against said stabilizing reinforcement.

15. The catalytic converter assembly according to claim 14, wherein said stabilizing reinforcement is a wall.

16. The catalytic converter assembly according to claim 1, wherein said catalytic converter has a first sheet and a second sheet forming a layer of said at most two layers, and said first sheet is thicker than said second sheet.

17. The catalytic converter assembly according to claim 16, wherein said first sheet is thicker than said second sheet by a factor of between 1.5 and 5.

18. The catalytic converter assembly according to claim 16, wherein said first sheet is thicker than said second sheet by a factor of between 2 and 4.

19. The catalytic converter assembly according to claim 16, wherein said first sheet is unstructured and said second sheet is said at least one structured sheet.

20. The catalytic converter assembly according to claim 1, wherein said catalytic converter has a flattened cross-section.

21. The catalytic converter assembly according to claim 1, wherein said housing has a housing surface and said catalytic converter has a surface disposed in opposite relationship to said housing surface and is adapted to said housing surface.

22. The catalytic converter assembly according to claim 1, wherein said catalytic converter has a profiled external surface to prevent unintended displacement of said catalytic converter in said housing.

23. The catalytic converter assembly according to claim 22, wherein said profiled external surface has profiling that is inclined tooth profiling.

24. The catalytic converter assembly according to claim 1, wherein said housing with said catalytic converter is to be part of an exhaust gas system.

25. The catalytic converter assembly according to claim 24, wherein said housing is a bend pipe the exhaust gas system.

26. The catalytic converter assembly according to claim 24, wherein said housing is a component of a muffler of the exhaust gas system.

27. The catalytic converter assembly according to claim 1, including a muffler receiving said housing with said catalytic converter, said muffler having a holder for receiving said housing with said catalytic converter.

28. The catalytic converter assembly according to claim 1, including a muffler receiving said housing and said catalytic converter, and a part of said muffler has means for fixing said housing with said catalytic converter.

29. The catalytic converter assembly according to claim 27, wherein said housing with said catalytic converter can be interchangeably inserted in said muffler.

30. The catalytic converter assembly according to claim 27, wherein said muffler has a reinforcement through which a force, including a clamping force, can be exerted on said housing with said catalytic converter.

31. The catalytic converter assembly according to claim 27, wherein a part of said housing with said catalytic converter is squeezed by said muffler.

32. The catalytic converter assembly according to claim 1, wherein said housing is an at least two part muffler housing of a muffler with a gas through-flow direction, said at least two part muffler housing having a partitioning wall dividing said muffler into a first region and a second region, at least one of said muffler and said partitioning wall has means for holding said catalytic converter in each respective region and said partitioning wall is disposed substantially parallel to said gas through-flow direction through said muffler.

33. The catalytic converter assembly according to claim 32, wherein each part of said at least two part muffler housing has an intermeshing locking mechanism which is used for holding said catalytic converter.

34. The catalytic converter assembly according to claim 2, wherein said bordered-in cross-sectional area constitutes at least two-thirds of said total of said cross-sectional area of said housing.

35. The catalytic converter assembly according to claim 2, wherein said oppositely disposed structurings are interlaced with each other without touching each other.

36. The catalytic converter assembly according to claim 2, wherein said bordered-in cross-sectional area constitutes at least three-quarters of said total of said cross-sectional area of said housing.

37. The catalytic converter assembly according to claim 2, wherein at least one of said housing and said catalytic converter has a stabilizing reinforcement.

38. The catalytic converter assembly according to claim 37, wherein said at least one structured sheet forming said closed passages of said catalytic converter bears against said stabilizing reinforcement.

39. The catalytic converter assembly according to claim 37, wherein said at least one structured sheet forming said closed passages of said catalytic converter has a top side and an underside, said top side and said underside of said at least one structured sheet each bear against a respective stabilizing reinforcement.

40. The catalytic converter assembly according to claim 2, wherein said at most two layers include a layer with an unstructured sheet and said at least one structured sheet.

41. The catalytic converter assembly according to claim 2, wherein said catalytic converter has an unstructured sheet with a top side and an underside, and a respective structured sheet is disposed at each of said top side and said underside of said unstructured sheet.

42. The catalytic converter assembly according to claim 2, wherein said structuring is a structuring selected from the group consisting of a corrugation configuration, a bend configuration and a scallop configuration.

43. The catalytic converter assembly according to claim 37, wherein said at most two layers include a layer and at least a part of said layer is flexible and bears against said stabilizing reinforcement.

44. The catalytic converter assembly according to claim 43, wherein said stabilizing reinforcement is a wall.

45. The catalytic converter assembly according to claim 2, wherein said catalytic converter has a first sheet and a second sheet forming a layer of said at most two layers, and said first sheet is thicker than said second sheet.

46. The catalytic converter assembly according to claim 45, wherein said first sheet is thicker than said second sheet by a factor of between 1.5 and 5.

47. The catalytic converter assembly according to claim 45, wherein said first sheet is thicker than said second sheet by a factor of between 2 and 4.

48. The catalytic converter assembly according to claim 45, wherein said first sheet is unstructured and said second sheet is said at least one structured sheet.

49. The catalytic converter assembly according to claim 2, wherein said catalytic converter has a flattened cross-section.

50. The catalytic converter assembly according to claim 3, wherein said thickness of said sheet being thicker than said given thickness of said at least one structured sheet by a factor of between 2 and 4.

* * * * *